US005461958A

United States Patent [19]

Dresdner et al.

[11] Patent Number: 5,461,958

[45] Date of Patent: Oct. 31, 1995

[54] ACOUSTIC GUITAR ASSEMBLY

[75] Inventors: Michael M. Dresdner, Easton; Robert K. Headman, Coopersburg, both of Pa.

[73] Assignee: C. F. Martin & Company, Inc., Pa.

[21] Appl. No.: 369,504

[22] Filed: Jan. 6, 1995

Related U.S. Application Data

[63] Continuation of Ser. No. 166,231, Dec. 10, 1993, abandoned.

[51] Int. Cl.[6] ..... G10D 1/08

[52] U.S. Cl. ..... 84/267; 84/291

[58] Field of Search ..... 84/267, 268, 269, 84/274, 291, 292, 293

[56] References Cited

U.S. PATENT DOCUMENTS

| | | | |
|---|---|---|---|
| 600,507 | 3/1898 | Bremerman | 84/291 |
| 3,474,697 | 10/1969 | Kaman | 84/267 |
| 3,656,395 | 4/1972 | Kaman | 84/267 |
| 3,685,385 | 8/1972 | Rendell | 84/267 |
| 3,892,159 | 7/1975 | Houtsma | 84/291 |
| 3,974,730 | 8/1976 | Adams, Jr. | 84/291 |
| 4,027,570 | 6/1977 | Rendell et al. | 84/267 |
| 4,079,654 | 3/1978 | Kasha | 84/291 |
| 4,084,475 | 4/1978 | Horowitz | 84/291 |
| 4,178,827 | 12/1979 | Mallory | 84/291 |
| 4,320,684 | 3/1982 | Podunavac | 84/291 |
| 4,483,234 | 11/1984 | Snavely | 84/291 |
| 4,638,708 | 1/1987 | Kamal | 84/293 |

*Primary Examiner*—Michael L. Gellner
*Assistant Examiner*—Cassandra Spyrou
*Attorney, Agent, or Firm*—Howson and Howson

[57] ABSTRACT

An acoustic guitar having a bracing on the underside of the soundboard which interconnects with the headblock and neck joint such that the soundboard is stiffened in cantilever fashion in a manner which resists failure in the region of the soundhole without affecting adversely the tonal qualities of the guitar.

13 Claims, 3 Drawing Sheets

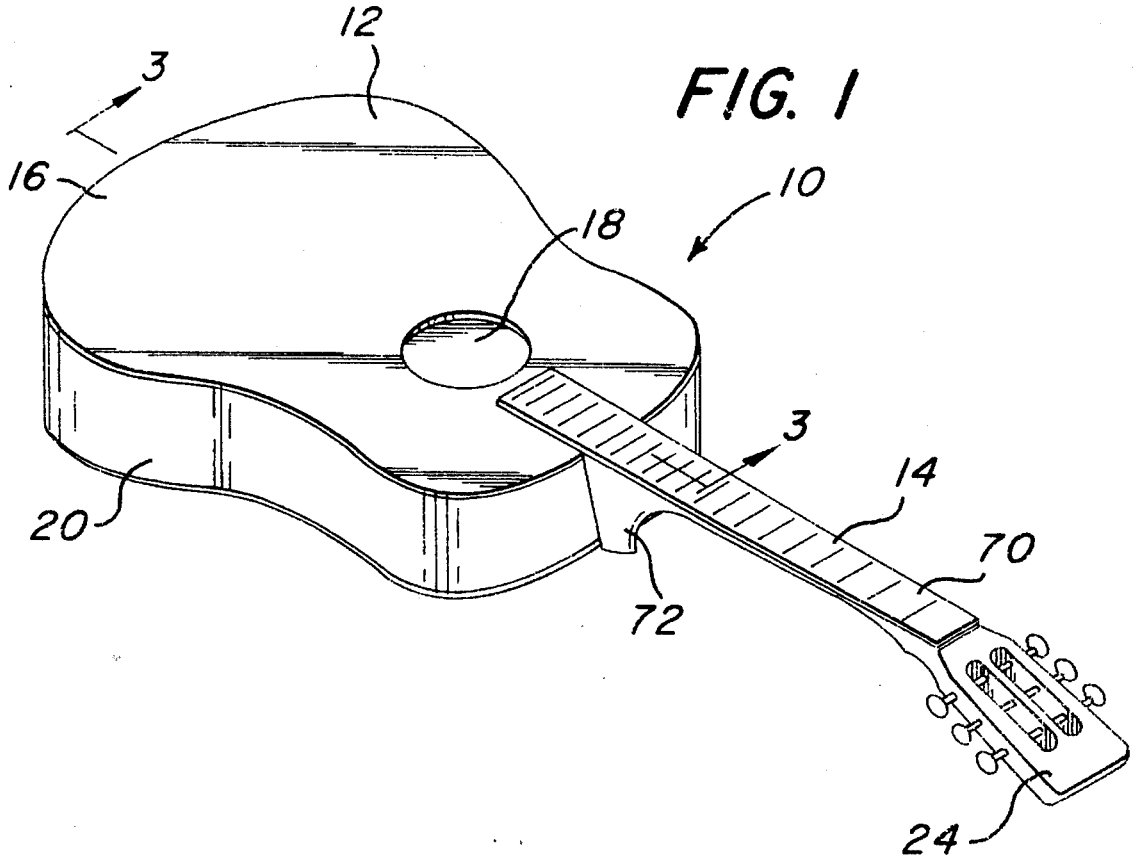
FIG. 1
FIG. 3
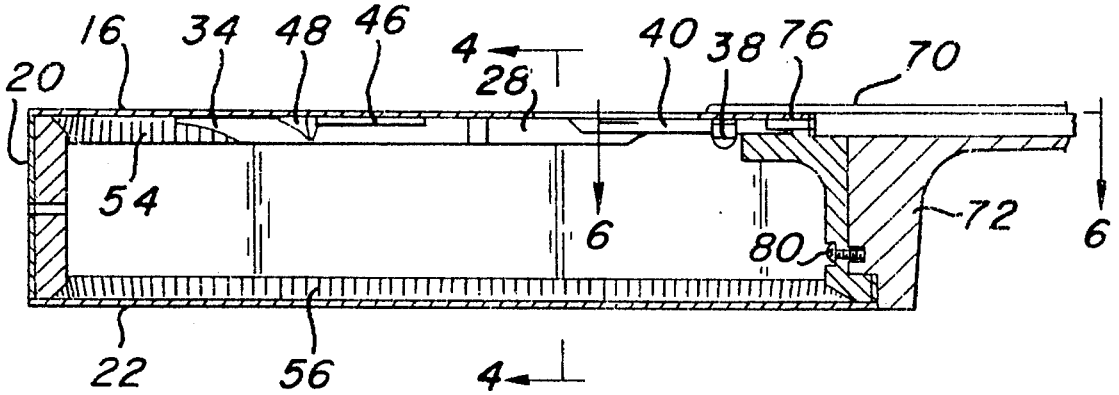

FIG. 5
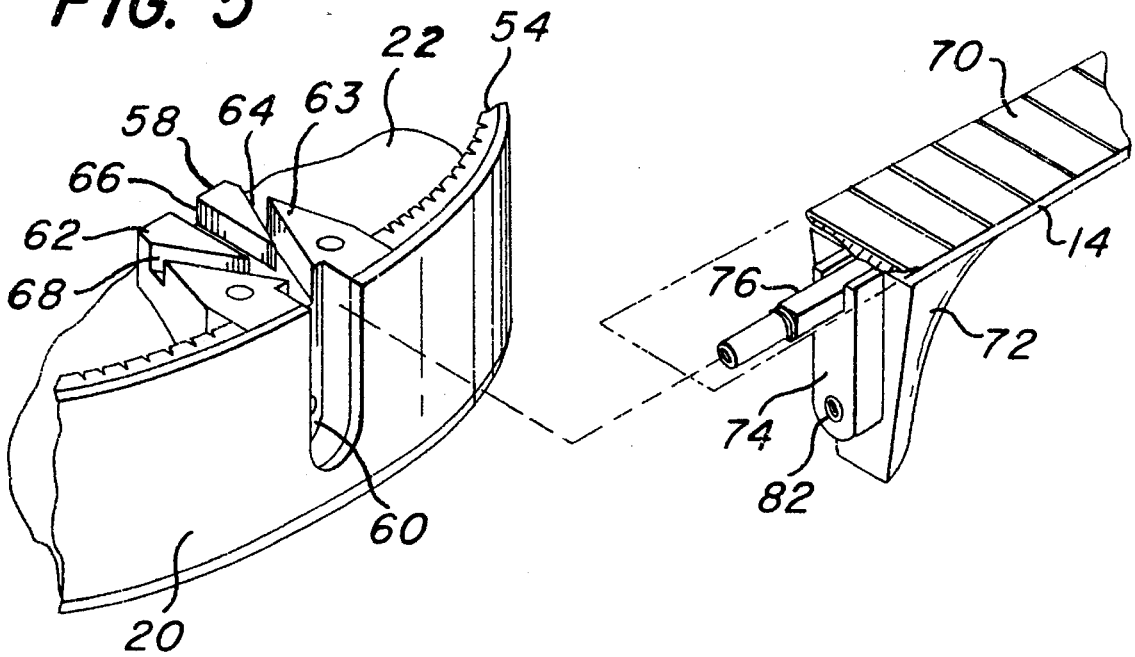
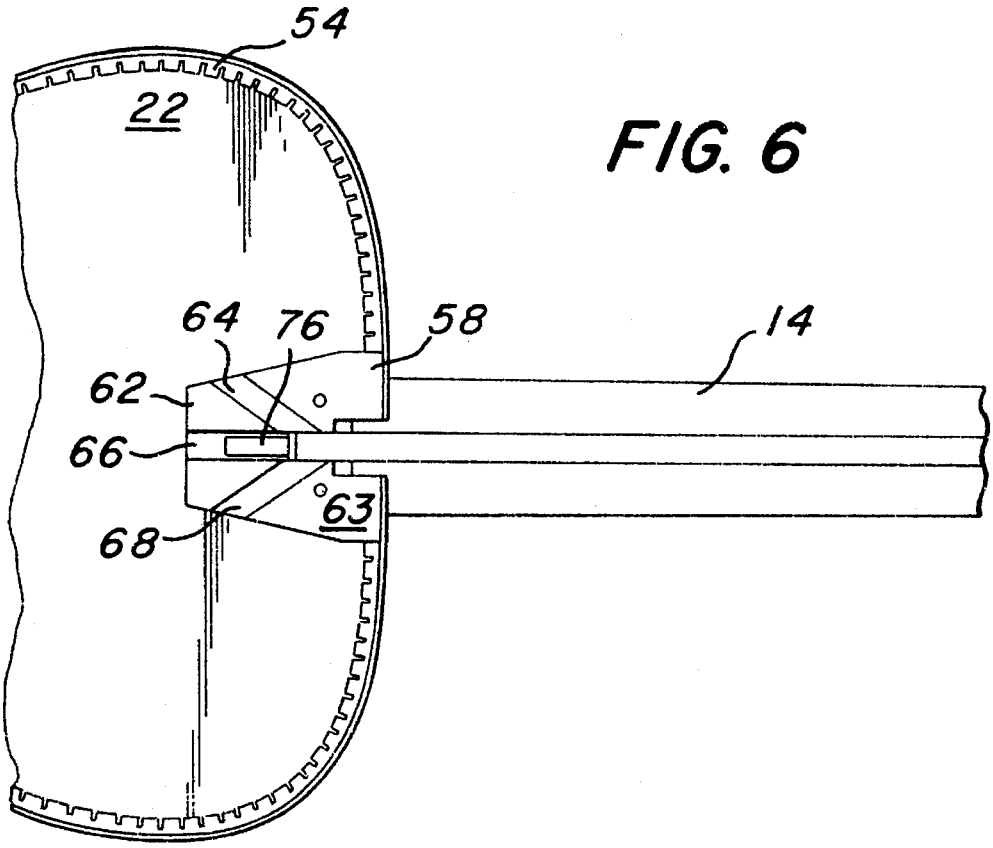
FIG. 6

ACOUSTIC GUITAR ASSEMBLY

This is a continuation of prior application Ser. No. 08/166,231, filed on Dec. 10, 1993 (now abandoned).

FIELD OF THE INVENTION

The present invention relates to an acoustic guitar, and more particularly, the present invention relates to improvements in the soundboard bracing structure and the neck to body joint of an acoustic guitar.

BACKGROUND OF THE INVENTION

The acoustic guitar is a popular musical instrument for both amateurs and professional musicians. The acoustic guitar has a hollow body connected to a neck. The body has a backboard and a soundboard, with a soundhole, connected to the backboard by a shaped sidewall. The neck and body are connected together at a neck to body joint.

The acoustic guitar has a series of strings strung at substantial tension from a bridge on the soundboard, across the soundhole, and along the neck. The string tension creates forces which act on the soundboard and the neck to body joint. Over time, these forces can cause bending, cracking or other damage to the soundboard, and they are the principal cause of structural failure and altered intonation of the acoustic guitar.

Prior art designs have attempted to improve upon the strength and durability of acoustic guitars without adversely affecting its playing qualities. For instance, U.S. Pat. Nos. 3,656,395; 3,685,385; and 4,079,654 disclose various bracing patterns on the underside of the soundboard. U.S. Pat. Nos. 3,974,730 and 4,027,570 disclose neck to body joint configurations for strengthening the joint area of the guitar.

In a high quality acoustic guitar, the bracing structure of the soundboard must be strong enough to withstand the forces created by the tensioned strings. However, the bracing structure must also allow the soundboard to vibrate sufficiently freely so that it does not interfere with the acoustical function of the soundboard. These requirements are at cross-purposes, and heretofore they have been very difficult to achieve by means of known techniques.

The neck to body joint of a quality acoustic guitar must secure the neck at a specific angle, or pitch, relative to the body. Variations from the design angle can adversely affect the playability of the guitar. Moreover, the neck to body joint must be stable enough to withstand the forces created by the tensioned strings. Heretofore, these goals have been difficult to achieve on a consistent basis using known guitar-making techniques.

OBJECTS OF THE INVENTION

With the foregoing in mind, a primary object of the present invention is to provide a high quality acoustic guitar having improved structural stability and playability.

Another object of the present invention is to provide an acoustic guitar having a unique soundboard bracing pattern for improving the durability of the guitar without adversely affecting its tonal qualities and playability.

A further object of the present invention is to provide an acoustic guitar having a unique neck to body joint which affords ease and accuracy of assembly without adversely affecting the playability of the guitar.

SUMMARY OF THE INVENTION

More specifically, the present invention accomplishes the aforementioned objects by means of a unique soundboard bracing pattern and neck to body joint assembly. The acoustic guitar has a body with a soundboard having a soundhole, a backboard spaced from said soundboard, and a shaped sidewall extending around and connecting the soundboard and backboard. A neck having a headstock extends from the body sidewall for tensioning strings across the soundhole.

The improvement comprises a means for bracing the soundboard adjacent to the soundhole to resist undesirable flexure of the soundboard without adversely affecting tonal qualities. The bracing means includes a pair of bracing strips extending tangentially along opposite sides of the soundhole on the underside of the soundboard and converging toward the guitar neck. The guitar neck has a headblock with a buttress extending into the guitar body below a portion of the neck. The buttress has a pair of converging upwardly-open channels for receiving the converging pair of bracing strips. The soundboard is thereby stiffened in cantilever fashion in a manner which resists failure in the region of the soundhole. Ancillary bracing strips are provided elsewhere on the soundboard.

BRIEF DESCRIPTION OF THE DRAWINGS

The foregoing and other objects, features and advantages of the present invention should become apparent from the following description when taken in conjunction with the accompanying drawing, in which:

FIG. 1 is a perspective view of an acoustic guitar embodying the present invention;

FIG. 3 is a cross-sectional view taken along line 3—3 of FIG. 1;

FIG. 5 is a fragmentary exploded perspective view of the neck to body joint aspect of the present invention; and FIG. 6 is a plan view taken along line 6—6 of FIG. 3.

DETAILED DESCRIPTION OF THE PREFERRED EMBODIMENTS

Figure 2:
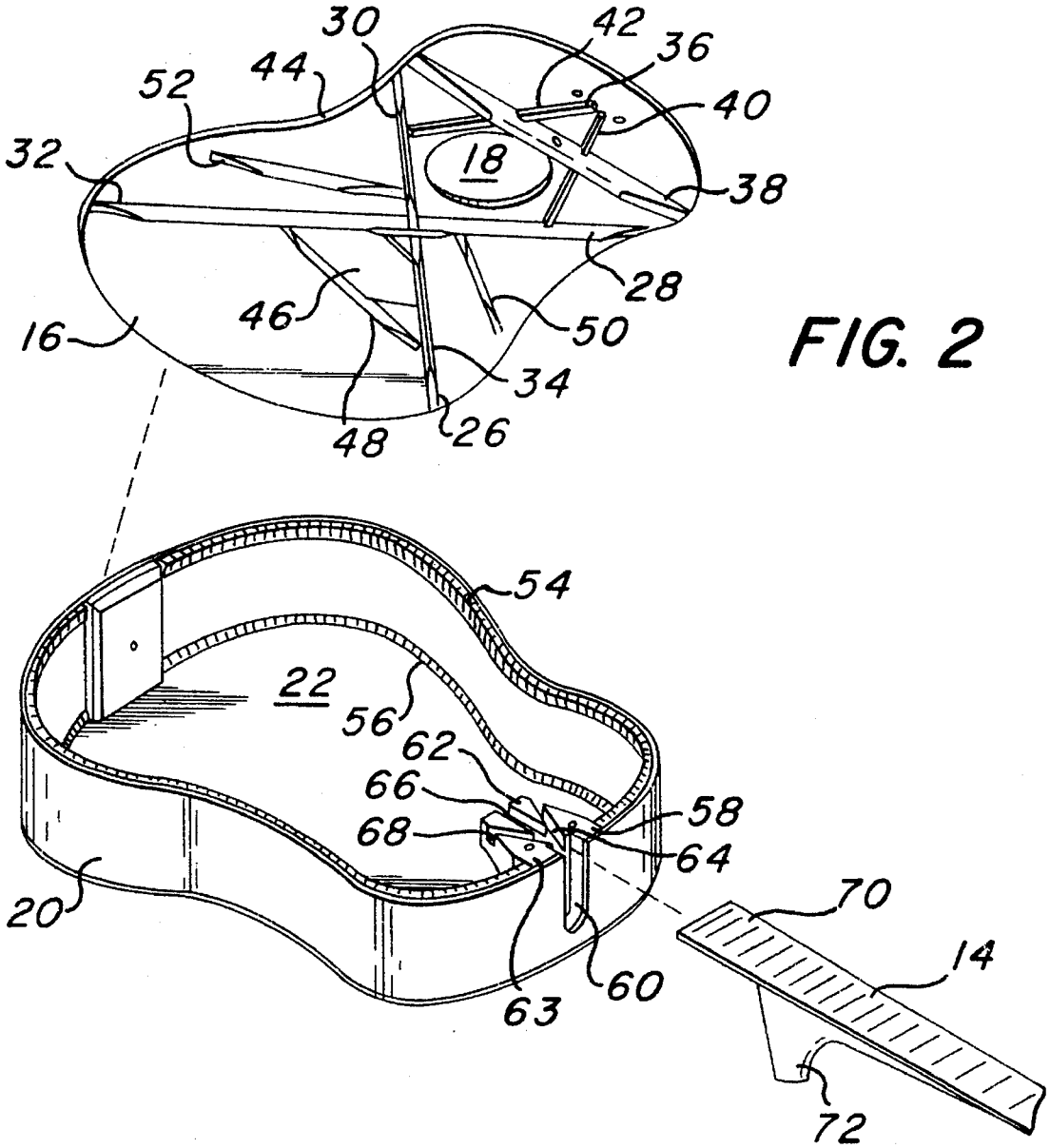
FIG. 2 is an exploded perspective view of an acoustic guitar embodying the present invention.
Figure 4:
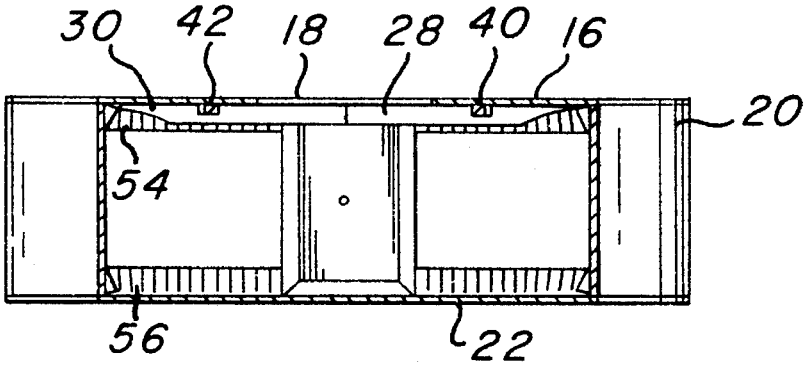
FIG. 4 is a cross-sectional view taken along line 4—4 of FIG. 3.

Referring now to the drawings, FIG. 1 illustrates an acoustic guitar 10 having a body 12 and a neck 14. The body 12 has a soundboard 16 with a circular soundhole 18. The soundboard 16 is connected to sidewall 20 which, in turn, is connected to a backboard 22. The neck 14 has a headstock 24. Strings (not shown) are strung from headstock 24, along the neck 14, across the soundhole 18, and to a bridge (not shown) on the soundboard 16.

It is important to protect the area of the soundboard 16 adjacent the soundhole 18. The tension created by the strings (not shown) causes damage most often to the soundboard 16 in the area between the soundhole 18 and the outer peripheral edge 44 of the soundboard 16. To this end, an X-brace 26 and an A-brace 36 are provided to completely encompass the soundhole 18 to support the area of the soundboard 16 adjacent the soundhole 18. This support prevents cracking, or extreme bending, of the soundboard 16 between the soundhole 18 and outer peripheral edge As best seen in FIG.2, the X-brace 26 extends across a substantial portion of the underside of the soundboard 16.

The legs 28 and 30 of the X-brace 26 structurally support the central area of the soundboard 16 adjacent the soundhole 18. The legs 32 and 34 structurally support the area of the soundboard 16 furthest from the neck 14.

An A-brace 36 extends across the portion of the underside of the soundboard 16 from the legs 28 and 30 of the X-brace 26 to the neck 14. The A-brace 36 has three legs 38, 40 and 42 which structurally support the area of the soundboard 16 adjacent the soundhole 18. The leg 38 extends transversely of the soundboard and neck between the soundhole 18 and the neck 14. The transverse leg 38 is notched to secure the legs 40 and 42 to the underside of the soundboard. The A-brace 36 also provides structural support for the neck to body joint as will be discussed later.

Further bracing is provided to protect other areas of the soundboard 16. Since the bridge (not shown) is located on the topside of the soundboard 16 and connects the strings (not shown) to the soundboard 16, the bridge location is an area of potential soundboard failure. An angled bridge plate 46 is located on the underside of the soundboard 16 opposite to the location of the bridge (not shown). The purpose of the angled bridge plate 46 is to provide structural support to the area of the soundboard 16 adjacent to the bridge (not shown). The bridge plate 46 is at an acute angle relative to the bridge (not shown) to minimize splitting along the grains of the wood of the bridge plate 46 and bridge.

A brace 48 is located adjacent the angled bridge plate 46. The brace 48 cooperates with the X-brace 26 to support the soundboard 16 and prevent cracking, or extreme bending, of the soundboard 16 between the angled bridge plate 46, the soundhole 18 and the outer peripheral edge 44. Braces 50 and 52 structurally support portions of the soundboard 16 remote from the neck 14. The braces 50 and 52 also cooperate with the X-brace 26 to prevent cracking, or extreme bending, of the soundboard 16 between the soundhole 18, the angled bridge plate 46 and the outer peripheral edge 44. The size, shape and position of the braces 50 and 52 can be altered. For instance, the shape of braces 50 and 52 can be modified to have a flat, rectangular shape, and the position of braces 50 and 52 can be such that they radiate from the edge of the underside of the bridge and extend substantially parallel to the legs 28 and 30 of the x-brace 26, respectively.

As best seen in FIG. 2, the soundhole 18 is surrounded by bracing. The bracing on the underside of the soundboard 16 must prevent damage, but not interfere with its acoustic function. The soundboard 16 must be allowed to flex an appropriate amount to produce a quality sound. While the bracing of the present invention prevents cracking and extreme bending of the soundboard 16, it allows the necessary flexure. To this end, several of the braces are tapered along their lengthwise edges and have shaped legs and ends for enhancing the acoustics of the soundboard 16. Alternate brace shapes may be used, for instance, the legs of x-brace 26 can have a gradual taper starting one inch from the center and continuing to their respective ends. Ribbon linings 54 and 56 are located on the sidewall 20 adjacent the soundboard 16 and the backboard 22.

The neck 14 must be firmly secured to the body 12 of the acoustic guitar 10, and must be strong enough to resist the forces acting on it by the tension of the strings. To this end, as best seen in FIG. 5, the underside of the end of the neck 14 is connected to the body 12 by a headblock 58 which provides the neck to body joint. The headblock 58 has a vertical channel 60 and an inwardly extending buttress 62. The buttress 62 has a top face 63 with a series of upwardly-open channels 64, 66 and 68. The top face 63 is adjacent the underside of the soundboard 16. The central upwardly open channel 66 extends the length of the buttress 62 and in the direction of the neck 14 for receiving neck structure as will be discussed. The outer upwardly open channels 64 and 68 converge toward the neck 14 for receiving portions of the A-bracing as will be discussed.

The structure of the end of the neck 14 cooperates with the headblock 58 and the soundboard 16 to firmly secure the neck 14 to the body 12. For this purpose, a fret board 70 is secured to the top of the neck 14, and the fret board 70 overhangs the neck 14, as shown by broken lines in FIG. 5. The end of the neck 14 opposite the headstock 24 has a heel 72. The heel 72 has a vertical projection 74 and a horizontal projection 76.

The neck to body joint of the present invention provides a sturdy joint while aiding in the prevention of cracking, or extreme bending, to the soundboard 16. To this end, the soundboard 16 is placed on the sidewall 20 such that the end portions of the A-brace legs 40 and 42 fit into the outer upwardly-open channels 64 and 68 of the buttress 62. The heel 72 of the neck 14 is connected by glue to the headblock 58 by inserting the horizontal projection 76 into the central upwardly open channel 66 and under the soundboard 16, as shown by FIG. 6, and by inserting the vertical projection 74 into the vertical channel 60 of the headblock 58. The portion of the fret board 70, which overhangs the heel 72, closely overlies a portion of the soundboard 16. A fastener 80 is secured through the headblock 58 and into a threaded hole 82 in the vertical projection 74 of the heel 72 to provide a means of clamping to allow the glue to set.

The interconnection of the bracing structure in the neck to body joint prevents damaging flexure while allowing a sufficient amount of flexure required to produce a quality sounding instrument. The soundboard is stiffened in cantilever fashion in a manner which resists failure in the region of the soundhole. This unique acoustic guitar structure results in a quality, long lasting instrument, which is straightforward to manufacture.

The type of wood used to make the guitar and the alignment of the wood grains can enhance the guitars structural integrity and acoustics. In one embodiment of the guitar, the backboard is made from two-piece solid mahogany. The sidewall is made from three-ply veneered laminated mahogany. The angled bridge plate is made of maple. The grain of the wooden bracing is arranged transversely to the plane on the soundboard.

The guitar is assembled and glued together using conventional materials. The structural features described facilitate manufacture in addition to providing the desired strength enhancement. Thus, the guitar is not only durable, but it is also capable of being manufactured economically.

While a preferred embodiment of an acoustic guitar has been described, various modifications, alterations and changes may be made without departing from the spirit and scope of the invention as defined in the appended claims.

We claim:

1. In an acoustic guitar having a body with a soundboard having a soundhole, a backboard spaced from said soundboard, a sidewall extending around and connecting the soundboard and backboard, and a neck extending from the body sidewall; the improvement comprising: means for bracing the soundboard adjacent to the soundhole for resisting undesirable flexure of the soundboard when the guitar is strung, said bracing means including a pair of bracing strips mounted along their entire lengths on the underside of the soundboard and extending along opposite sides of the soundhole and converging toward the guitar neck having a headblock with a buttress extending into the guitar body below the neck, said buttress having a top surface adjacent said soundboard, said top surface having a pair of converging channels open upwardly toward said soundboard for receiving said pair of bracing strips, whereby the soundboard is stiffened in cantilever fashion in a manner which resists failure in the region of the soundhole without effecting adversely the tonal qualities of the guitar.

2. An acoustic guitar assembly according to claim 1, including a strip disposed transversed to said strips between said soundhole and said neck to define an A-brace.

3. An acoustic guitar assembly according to claim 2, including a X-brace having a pair of legs extending along opposite sides of said soundhole on the end thereof opposite said A-brace for cooperating therewith to surround said soundhole.

4. An acoustic guitar, comprising:

a body having a soundboard with a soundhole, a backboard spaced from said soundboard, and a sidewall extending around and connecting said soundboard and said backboard;

a headblock integral with said sidewall, said headblock having a buttress extending into said body, said buttress having a top surface adjacent said soundboard, said top surface having a pair of converging channels upwardly-open toward the underside of the soundboard;

a neck extending from said headblock; and a pair of braces mounted along their entire lengths on the underside of said soundboard, said braces extending along opposite sides of said soundhole and converging toward said neck, said braces being received and secured in said channels;

whereby said soundboard is stiffened in cantilever fashion to resist damaging flexure in the area of said soundhole without affecting adversely the tonal qualities of the guitar.

5. An acoustic guitar assembly according to claim 4, wherein said soundboard has an X-brace with a pair of legs extending along opposite sides of said soundhole, whereby said pair of braces and said X-brace surround said soundhole.

6. An acoustic guitar assembly according to claim 5, wherein said pair of braces are intersected by a transverse leg which extends across substantially the entire width of the soundboard between the soundhole and the neck, and bridges across said pair of braces.

7. An acoustic guitar assembly according to claim 6, wherein said X-brace and said transverse leg have tapered and shaped ends.

8. In an acoustic guitar having a body with a soundboard having a soundhole, a sidewall around the periphery of the body, a backboard opposite the soundboard, and a neck extending from the sidewall; the improvement comprising:

a headblock integral with the sidewall where the neck attaches to the body, said headblock having a buttress which extends inward of the body and underneath a portion of the neck, said buttress having a top surface with converging outer channels adjacent the underside of the soundboard and a central channel, said converging channels and said central channel being open-upwardly toward the underside of said soundboard, said buttress having a vertical channel extending between said soundboard and said backboard;

means for bracing the underside of the soundboard, said bracing means including an X-brace and an A-brace mounted along their entire lengths to the underside of the soundboard, said A-brace having an apex portion received in said outer channels; and a heel depending laterally from said neck, said heel having a vertical and a horizontal projection extending transverse and along said neck, respectively, said vertical projection received by said vertical channel in said headblock, and said horizontal projection received by said central upwardly-open channel in said headblock;

whereby the soundboard is stiffened in cantilever fashion in a manner which resists failure in the region of the soundhole, and the neck is connected to the body by a stiff joint.

9. An acoustic guitar assembly according to claim 8, wherein said X-brace has a pair of legs extending along opposite sides of said soundhole, whereby said A-brace and said X-brace surround said soundhole.

10. An acoustic guitar assembly according to claim 9, wherein said A-brace has a transverse leg which extends across substantially the entire width of the soundboard between the soundhole and the neck.

11. An acoustic guitar assembly according to claim 10, wherein said X-brace and said transverse leg of said A-brace have tapered and shaped ends.

12. An acoustic guitar assembly according to claim 11, wherein the sidewall has an interior ribbon lining for supporting the soundboard.

13. An acoustic guitar assembly according to claim 12, wherein the sidewall has an interior ribbon lining for supporting the backboard.

* * * * *